US007017346B2

(12) United States Patent
Schürz et al.

(10) Patent No.: US 7,017,346 B2
(45) Date of Patent: Mar. 28, 2006

(54) DEVICE FOR TRANSMITTING A DISPLACEMENT OF AN ACTUATOR USING AN ELASTOMER RING

(75) Inventors: Willibald Schürz, Pielenhofen (DE); Martin Simmet, Bad Abbach (DE); Hanspeter Zink, Regensburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/034,499

(22) Filed: Jan. 13, 2005

(65) Prior Publication Data

US 2005/0120714 A1 Jun. 9, 2005

Related U.S. Application Data

(63) Continuation of application No. PCT/DE03/02328, filed on Jul. 15, 2003.

(30) Foreign Application Priority Data

Jul. 25, 2002 (DE) ..... 102 33 907

(51) Int. Cl.
*F15B 5/00* (2006.01)

(52) U.S. Cl. ..... 60/583; 60/592; 92/165 R

(58) Field of Classification Search ..... 60/583, 60/584, 592; 92/142, 165 R
See application file for complete search history.

(56) References Cited

U.S. PATENT DOCUMENTS 3,335,642 A * 8/1967 Rosaen ..... 92/165 R
4,858,439 A * 8/1989 Sawada et al. ..... 60/583

FOREIGN PATENT DOCUMENTS

DE 195 00 706 A1 7/1996
WO WO 01/57393 A2 8/2001

* cited by examiner

*Primary Examiner*—Thomas E. Lazo
(74) *Attorney, Agent, or Firm*—Baker Botts L.L.P.

(57) ABSTRACT

A device for transmitting a displacement of an actuator to a setting element comprises two pistons that delimit two transmission chambers and a compensation chamber with a housing. The compensation chamber is hydraulically connected to the two transmission chambers. The transmission chambers transmit a displacement of the first piston in order to effect a displacement of the second piston. The compensation chamber serves as a reservoir for the transmission medium with which the transmission chambers are filled. The compensation chamber is delimited by an elastomer ring. The elastomer ring depicts a simple and economical realization with which it is possible to subject the compensation chamber to the action of pressure and to change the volume of the compensation chamber at the same time. In a preferred embodiment, the elastomer ring is externally subjected to the action of a tension force via a pressure ring.

20 Claims, 3 Drawing Sheets

DEVICE FOR TRANSMITTING A DISPLACEMENT OF AN ACTUATOR USING AN ELASTOMER RING

CROSS REFERENCE TO RELATED APPLICATION

This application is a continuation of copending International Application No. PCT/DE03/02328 filed Jul. 15, 2003 which designates the United States, and claims priority to German application no. 102 33 907.4 filed Jul. 25, 2002.

TECHNICAL FIELD OF THE INVENTION

This invention relates to a device for transmitting a displacement of an actuator using an elastomer ring.

DESCRIPTION OF RELATED ART AND BACKGROUND OF THE INVENTION

The use of devices for transmitting a displacement of an actuator is known in the field of injection valves. The device thereby sets the required clearance for example between the actuator and a setting element to be controlled. Depending on the embodiment of the device, it is also possible to achieve a translation of the displacement of the actuator. For example, with piezoelectric actuators, it is advantageous to increase the relatively slim displacement lift of the piezoelectric actuator, in order to control for example a closing element of a valve or an injection needle.

To transmit the displacement, transmission chambers are provided that are delimited by a first and a second piston and a housing. The transmission chambers are filled with a transmission medium, such as hydraulic oil. For the device to function correctly, it is necessary for there to be minimum pressure in the transmission chambers. To this end, the transmission chambers are hydraulically connected to a compensation chamber. The compensation chamber is used to compensate any change in volume of the transmission chambers and to provide the transmission chambers with a transmission medium at a defined pressure. For the volume of the compensation chamber to be flexible, it is known for the compensation chamber to be sealed using a metal membrane, enabling the volume of the compensation chamber to change. However, sealing the chamber using a metal membrane is relatively complicated and the metal membrane itself is relatively expensive.

SUMMARY OF THE INVENTION

The object of the invention is to provide a device to transmit a displacement of an actuator, which does not require a metal membrane.

A considerable advantage of the device according to the invention is that the compensation chamber is delimited by an elastomer ring. The use of elastomer makes it possible on the one hand to vary the volume in the compensation chamber and on the other to subject the fluid in the compensation chamber to the action of pressure. By using a ring made out of elastomer, it is possible to seal relatively high pressures via the elastomer.

In a simple embodiment, the elastomer ring is connected in a circumferentially sealed manner to an inner wall of a housing on the outside and to a piston rod on the inside.

Depending on the manufacturing method used, it is advantageous to provide a first and/or a second sleeve on the outside and/or inside of the elastomer ring. The first outer sleeve is connected in a circumferentially sealed manner to the inner wall of the housing and to the elastomer ring. The second inner sleeve is connected in a circumferentially sealed manner to the first piston or the piston rod and to the elastomer ring. By using the outer sleeve, it is possible to configure the inner wall of the housing so that it is shorter. Furthermore, the surface of the inner wall of the housing does not have to be suitable for use in a vulcanization process, the elastomer being connected in a sealed manner to the inner wall. Greater flexibility is therefore provided in manufacturing the inner wall. It is also possible, for example, for the outer sleeve to be connected in a circumferentially sealed manner to a face end of the housing. Increased flexibility is therefore provided with respect to the region of the connection between housing and elastomer ring.

The use of the second, inner sleeve also makes it possible to manufacture the piston and/or the piston rod independently of the hydraulically sealed connection to the elastomer ring. Increased flexibility is therefore also provided in manufacturing the piston rod.

Furthermore, it is possible to carry out the vulcanization process, in which the elastomer is connected in a circumferentially sealed manner to the inner and outer sleeves, independently of the housing and first piston. It is not until after the process of connecting the elastomer ring to the outer and inner sleeves that the outer and inner sleeves are welded in a circumferentially sealed manner to the housing and/or to the piston or piston rod. The first and second sleeves are preferably made of steel.

The elastomer used has an elasticity that can however diminish when subjected to high pressures in the compensation chamber or for longer periods. To stabilize the elastomer ring, a tension device is preferably provided, which subjects the outside of the elastomer ring to the action of pretension. In this way, the elastic function of the elastomer ring is supported by the tension device.

A preferred embodiment of the tension device is the configuration of a spiral spring, which is clamped between the elastomer and a lay-on surface firmly connected to the piston rod. This creates a means of pretensioning which is independent of the position of the first piston.

To introduce the pretension effectively, it is advantageous to provide a pressure transmission device, which transmits the pretension evenly onto the elastomer ring. By transmitting the pretension evenly, it is possible to avoid local overloading of the elastomer ring.

The pressure transmission device is preferably in the form of a ring.

The ring preferably has a graduated guide, the ring being guided on the piston rod and furthermore the part of the ring with the larger diameter being supported on the elastomer ring. By guiding the ring parallel to the piston rod, the pretensioning force is evenly transmitted to the elastomer ring over the entire ring surface. By guiding the ring along the piston rod, it is possible to avoid tilting the ring and thus only partially loading the elastomer ring.

It is furthermore advantageous to protect the surface of the elastomer ring on which the tension device is acting by means of a protective film. The function of the protective film is to reduce the amount of wear and tear on the surface of the elastomer ring. The protective film is preferably configured in the form of a rubber film, which is affixed to the ring.

BRIEF DESCRIPTION OF THE DRAWINGS

The invention will now be shown in more detail with reference to the figures, in which.

DETAILED DESCRIPTION OF EMBODIMENTS

The invention is shown below using the example of an injection valve 1. However, the use of the transmission device according to the invention is not restricted to injection valves, as the transmission device according to the invention can be used in diverse technical fields to transmit a displacement of an actuator.

Figure 1:
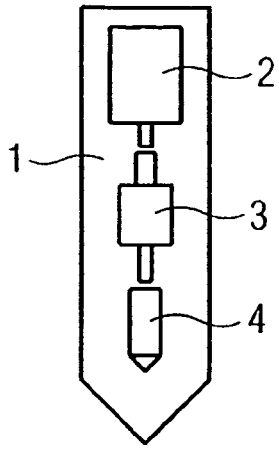
FIG. 1 shows a schematic representation of an injection valve.

FIG. 1 shows an injection valve 1 with an actuator 2 mechanically linked to an injection valve needle 4 via a transmission device 3. The actuator 2 is for example configured as a piezoelectric actuator and the transmission device 3 preferably has a translation function, so that a displacement of the actuator 2 is transmitted in the direction of the injection needle 4 by the transmission device 3 in order to effect a larger displacement of the injection needle 4. The injection needle 4 is assigned to injection holes of the injection valve. As a function of the displacement of the actuator 2, the injection needle 4 releases the injection holes, so that fuel is injected into an internal combustion engine via the injection holes.

Depending on the embodiment, the transmission device 3 can also have an inverse function, so that the setting element that is mechanically linked to the injection needle 4 is withdrawn from the injection needle 4 when the actuator 2 is displaced in the direction of the injection needle 4.

Instead of the translation function, the transmission device 3 can also have a pure transmission function, the displacement of an actuator being transmitted in order to effect a corresponding displacement of the injection needle.

Figure 5:
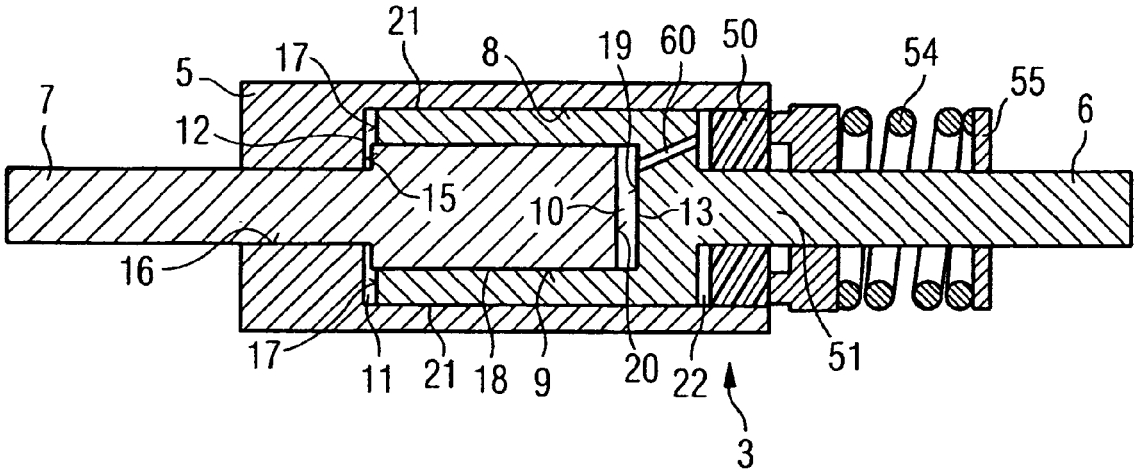
FIG. 5 shows a further transmission device.

FIG. 5 shows a more precise representation of the transmission device 3.

A first piston 6 is provided in the form of a sleeve that is open on one side. The sleeve-shaped part of the piston delimits a first transmission chamber 10, into which a second piston 7 is guided. The first and second pistons 6, 7 delimit the first transmission chamber 10. The first piston 6 is in turn guided in a cylinder-shaped chamber of a housing, which has an end surface 15 on the face end to the first piston 1. An aperture 16 is placed in the end surface 15, through which a piston rod of the second piston 7 is guided. The piston rod has a smaller diameter than the second piston 7. The piston rod passes via a ring-shaped recess in the wider diameter of the second piston 7. A second transmission chamber 11 is configured between the end surface 5, the recess and a ring-shaped face surface 17 of the first piston 6. The second transmission chamber 11 is hydraulically connected to the first transmission chamber 10 via a first sealing gap 18, which is configured between a side wall of the second piston 7 and inner wall of the first piston 6. The first transmission chamber 10 is delimited by a second end surface 19 of the first piston 6 and a second face surface 20 of the second piston 7. The first sealing gap 18 is designed in a narrow manner so that transient pressure differences are not compensated. Furthermore, the second transmission chamber 11 is connected to a compensation chamber 22 via a second sealing gap 21, which is configured between the outer wall of the first piston 6 and the inner wall of the housing 4. The first transmission chamber 10 is hydraulically connected to the compensation chamber 22 via a bore 60, which is placed in the first piston 6. The first piston 6 passes into the piston rod 51 via a second recess. The piston rod 51 is essentially in the form of a cylinder and has a smaller diameter than the first piston 6.

In a first embodiment according to FIG. 5, an elastomer ring is placed between the housing and the second piston 7 and/or the piston rod 51 of the first piston 6. The elastomer ring 50 is thereby connected in a circumferentially sealed manner to the housing 5 on the outside and to the piston rod 51 on the inside. A vulcanization method is used to effect the connection. The housing 5 and the first piston 6 having piston rod 51 are made of steel.

The geometry of the elastomer ring is such that the elastomer ring has sufficient elasticity and at the same time the necessary stability to delimit the pressure of the compensation chamber 22. Due to its elastic properties, the elastomer ring should enable the volume in the compensation chamber to grow and also prevent too high an increase in pressure.

The first and second transmission chambers 10, 11 and the compensation chamber are filled with a transmission fluid. In this way, it is possible to achieve a motive link between the first and second pistons 6, 7. If the first piston 6 is moved deeper into the housing 5 by the actuator, the second piston 7 is in turn moved deeper into the housing 5. Inverse motion is thus achieved between the first and second pistons 6, 7. The compensation chamber 22 is connected to the second transmission chamber 11 via the second sealing gap 21, the second sealing gap 21 being designed in such a narrow manner that transient pressure differences between the transmission chamber 11 and the compensation chamber 22 are not compensated. The term transient is understood to mean activating times of the actuator that the actuator requires in order to activate a setting element, in the example shown to activate the injection needle.

Pressure differences lasting for a longer period of time are compensated via the second sealing gap 21 between the second transmission chamber and the compensation chamber 22. In this way, it is possible to automatically achieve a compensation of clearance. The first and second pistons 6, 7 can therefore always be laid onto an actuator and/or a setting element. The transmission element is preferably under pressure. The pressure can for example be transmitted to the transmission fluid via the elastomer ring 50 using a tension device. Instead of the embodiment shown in FIG. 2, it is also possible to select other arrangements of the transmission chambers, so that a movement of the first piston 6 is transmitted in order to effect a movement of the second piston 7 in the same direction.

Figure 2:
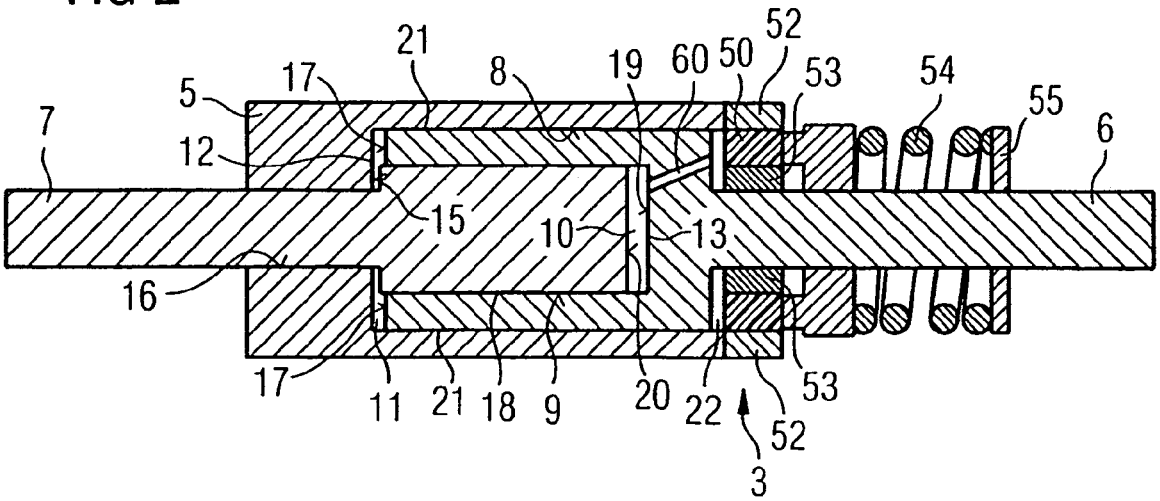
FIG. 2 shows a transmission device.

In a preferred embodiment according to FIG. 2, the elastomer ring 50 is connected to a first outer sleeve 52 on the outside and to a second inner sleeve 53 on the inside. The first sleeve 52 is connected in a circumferentially sealed manner to the housing 5, preferably welded. The connection surface can be arranged on the inside or on a face end of the housing. On the inside surface, the second sleeve 53 is connected in a circumferentially sealed manner to the piston rod 51, preferably welded. Using an outer and inner sleeve 52, 53 has the advantage of making it possible to carry out the connection process between the elastomer ring 50 and the outer and inner sleeve 52, 53 independently of the connection process between the outer and inner sleeve 52, 53 and the housing 5 and/or piston rod 51.

In a preferred embodiment, a tension device is provided, which is used to pretension the elastomer ring 50 in the direction of the compensation chamber 22. In a simple embodiment, a spiral spring 54 is provided for this purpose, which is clamped between a stop ring 55 and the elastomer ring 50. The stop ring 55 is connected firmly to the piston rod 51. In a preferred embodiment, a pressure transmission device is provided between the tension device and the elastomer ring 50, said pressure transmission device transmitting the pretension force of the spiral spring 54 having a larger surface to the surface of the elastomer ring 50. The pressure transmission device is preferably configured in the form of a pressure ring 56. The pressure ring 56 preferably has a support surface essentially corresponding to the surface of the elastomer ring 50. In a further preferred embodiment, the pressure ring 56 has a graduated guide, the pressure ring 56 being guided by the piston rod 51 in the area of the guide with the smaller diameter. In this way, the pressure ring 56 is guided axially, so that the pressure ring 56 is not able to tilt. In this way it is possible to ensure that the pressure ring 56 evenly transmits the pretension force preset by the spiral spring 54 onto the elastomer ring 50 via the lay-on surface of the pressure ring 56.

Figure 3:
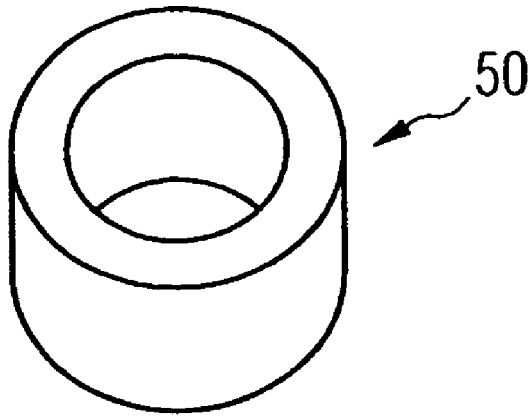
FIG. 3 shows a perspective representation of an elastomer ring.

FIG. 3 shows a schematic representation of the elastomer ring 50.

Figure 4:
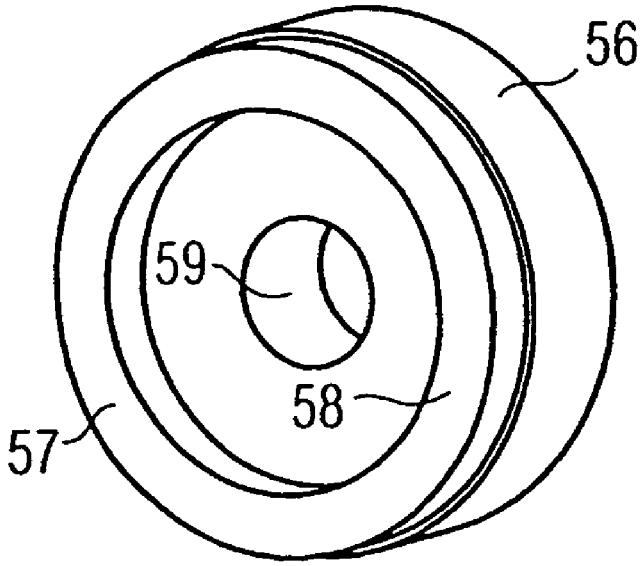
FIG. 4 shows a plan view of a pressure ring.

FIG. 4 presents a view of the pressure ring 56 from below, clearly showing a contact surface 58, which is used to support the pressure ring 56 on the elastomer ring 50. The guide aperture 59 is also shown, through which the piston rod 51 is guided in a finally constructed state and via which the pressure ring 56 is guided in such a manner that it can move axially in the axial direction of the piston rod 51. In this way it is possible to avoid tilting the support surface of the pressure ring 56.

In a preferred embodiment, a protective film 57 is affixed to the surface of the pressure ring 56, which is assigned to that of the elastomer ring 50. The protective film 57 is comprised for example of rubber and serves to protect the elastomer ring 50 from abrasion due to the pressure ring 56. The protective film 57 preferably has a greater hardness than the elastomer ring 50.

We claim:

1. A device to transmit a displacement of an actuator, in particular for an injection valve, with a housing, the housing comprising a first opening, a first and second piston being supported in a moveable manner in the first opening, the first and second pistons being mechanically linked via a fluid through at least one transmission chamber, the mechanical link causing a shift in the second piston, when the first piston is moved and vice versa, wherein the transmission chamber is hydraulically connected to a compensation chamber formed within said housing via a sealing gap, the sealing gap compensates pressure differences between the transmission chamber and compensation chamber in a delayed manner, the compensation chamber is delimited by a ring made out of elastomer, and the ring is connected in a sealed manner to the housing and in a sealed manner to a piston.

2. The device according to claim 1, wherein the first piston has a second opening, in which the second piston is guided in a moveable manner, the second piston in the second opening delimits a first transmission chamber, a face surface of the first piston and a reverse side of the second piston, which is bordered by the face surface, delimiting a second transmission chamber with an end surface of the housing, the first transmission chamber is hydraulically connected to the second transmission chamber via a first sealing gap, which is configured between an inner wall of the first piston and outer wall of the second piston, the first transmission chamber is connected to the compensation chamber via a bore, the second transmission chamber is hydraulically connected to the compensation chamber via a second sealing gap, which is configured between an outer wall of the first piston and inner wall of the housing, and the compensation chamber is delimited by the inner wall of the housing and by the first piston or a piston rod of the first piston.

3. The device according to claim 1, wherein a first and second sleeve is provided on the outside and/or inside of an elastomer ring, the first sleeve is connected in a circumferentially sealed manner to the housing and to the elastomer ring, the second sleeve is connected in a circumferentially sealed manner to the first piston or the piston rod and to the elastomer ring.

4. The device according to claim 1, wherein a tension device is provided, the tension device supports the elastomer ring against an outward displacement or externally subjects it to pretension.

5. The device according to claim 4, wherein a transmission device is provided, which transmits pretension evenly onto the elastomer ring.

6. The device according to claim 5, wherein the transmission device is configured in the form of a ring.

7. The device according to claim 6, wherein the ring has a guide with a graduated diameter, the part of the ring having the smaller diameter is guided on the piston rod, and the part of the ring having the larger diameter is supported on the elastomer ring.

8. The device according to claim 5, wherein a protective film is affixed on the surface of the transmission device, which acts on the elastomer ring, said film attenuating the action on the elastomer ring.

9. The device according to claim 8, wherein the protective film is configured in the form of a rubber film.

10. The device according to claim 4, wherein the tension device is configured in the form of a spiral spring, the spiral spring is clamped between the elastomer ring and a support surface, which is connected to the piston rod.

11. A device to transmit a displacement of an actuator, in particular for an injection valve, with a housing comprising:

a first opening, a first and second piston being supported in a moveable manner in the first opening, wherein the first and second pistons are mechanically linked via a fluid through at least one transmission chamber, and the mechanical link causes a shift in the second piston, when the first piston is moved and vice versa, a compensation chamber to which the transmission chamber is hydraulically connected via a sealing gap, wherein the sealing gap compensates pressure differences between the transmission chamber and compensation chamber in a delayed manner, and a ring made out of elastomer for delimiting the compensation chamber, wherein the ring is connected in a sealed manner to the housing and in a sealed manner to a piston.

12. The device according to claim 11, wherein the first piston has a second opening, in which the second piston is guided in a moveable manner, the second piston in the second opening delimits a first transmission chamber, a face surface of the first piston and a reverse side of the second piston, which is bordered by the face surface, delimiting a second transmission chamber with an end surface of the housing, the first transmission chamber is hydraulically connected to the second transmission chamber via a first sealing gap, which is configured between an inner wall of the first piston and outer wall of the second piston, the first transmission chamber is connected to the compensation chamber via a bore, the second transmission chamber is hydraulically connected to the compensation chamber via a second sealing gap, which is configured between an outer wall of the first piston and inner wall of the housing, and the compensation chamber is delimited by the inner wall of the housing and by the first piston or a piston rod of the first piston.

13. The device according to claim 11, wherein a first and second sleeve is provided on the outside and/or inside of an elastomer ring, the first sleeve is connected in a circumferentially sealed manner to the housing and to the elastomer ring, the second sleeve is connected in a circumferentially sealed manner to the first piston or the piston rod and to the elastomer ring.

14. The device according to claim 11, wherein a tension device is provided, the tension device supports the elastomer ring against an outward displacement or externally subjects it to pretension.

15. The device according to claim 14, wherein a transmission device is provided, which transmits pretension evenly onto the elastomer ring.

16. The device according to claim 15, wherein the transmission device is configured in the form of a ring.

17. The device according to claim 15, wherein a protective film is affixed on the surface of the transmission device, which acts on the elastomer ring, said film attenuating the action on the elastomer ring.

18. The device according to claim 17, wherein the protective film is configured in the form of a rubber film.

19. The device according to claim 16, wherein the ring has a guide with a graduated diameter, the part of the ring having the smaller diameter is guided on the piston rod, and the part of the ring having the larger diameter is supported on the elastomer ring.

20. The device according to claim 14, wherein the tension device is configured in the form of a spiral spring, the spiral spring is clamped between the elastomer ring and a support surface, which is connected to the piston rod.

* * * * *